US005662561A

United States Patent [19]

McNamara

[11] Patent Number: 5,662,561

[45] Date of Patent: Sep. 2, 1997

[54] WEIGHTED HANDLE FOR A JUMP ROPE

[76] Inventor: Thomas McNamara, 435 W. 23rd St., Apt. 4C, New York, N.Y. 10011

[21] Appl. No.: 692,980

[22] Filed: Aug. 7, 1996

Related U.S. Application Data

[63] Continuation of Ser. No. 393,087, Feb. 22, 1995, abandoned.

[51] Int. Cl.[6] ..... A63B 5/20

[52] U.S. Cl. ..... 482/82

[58] Field of Search ..... 482/3, 50, 82, 482/74, 81, 148; 434/255

[56] References Cited

U.S. PATENT DOCUMENTS

| | | | |
|---|---|---|---|
| 4,157,827 | 6/1979 | Winston et al. | 482/82 |
| 4,351,348 | 9/1982 | Axton | 482/74 |
| 4,371,945 | 2/1983 | Karr et al. | 482/74 |
| 4,593,903 | 6/1986 | Waitz | 482/82 |
| 4,647,037 | 3/1987 | Donohue | 482/82 |
| 4,778,173 | 10/1988 | Joutras | 482/82 |
| 4,787,624 | 11/1988 | Grant | 482/82 |
| 4,801,137 | 1/1989 | Douglas | 482/82 |

OTHER PUBLICATIONS

Popular Science "Digital Rope". Dec. 1977 p. 83.

*Primary Examiner*—Stephen R. Crow
*Attorney, Agent, or Firm*—White & Case

[57] ABSTRACT

A pair of weighted handles for a jump rope is provided. Each weighted handle includes an attachment connected to the jump rope. The attachment is internally threaded and is connected to an externally threaded handweight. The handweight may be quickly attached to or detached from the attachment simply by screwing it to or unscrewing it from the attachment. A stopwatch is optionally provided on the exterior face of one attachment.

3 Claims, 4 Drawing Sheets

WEIGHTED HANDLE FOR A JUMP ROPE

This application is a continuation of application Ser. No. 08/393,087 filed Feb. 22, 1995, now abandoned.

BACKGROUND OF THE INVENTION

1. Field of the Invention

The present invention relates generally to jump ropes used in aerobic exercise, and more specifically, to a jump rope for cross-training which includes removable weighted handles. In particular, the invention relates to a streamlined weighted handle for a jump rope which may be quickly and easily attached to or detached from the jump rope.

2. Description of the Prior Art.

Jump ropes have long been used in aerobic exercise routines. Handweights are also frequently used in such routines. The use of handweights attached to a jump rope has also been proposed. However, the weighted handle jump ropes presently available are bulky, and too many steps are required to attach or detach the handweights. This adverse feature prohibits efficient cross-training combining aerobic and strengthening exercises.

For instance, U.S. Pat. No. 4,787,624 to Jerry A. Grant discloses a C-shaped adapter for attaching a jump rope to a typical handweight having two weights screwed onto opposite threaded ends of a handle. The attachment requires three steps. First, a weight is unscrewed from one end of the handle. The C-shaped adapter is then slid over the end. Finally, the weight is screwed back onto the handle. These steps must be carried out to attach a handweight to each end of the jump rope. To detach the handweights from the jump rope, the same steps are performed in reverse order.

None of the prior art weighted handle jump ropes consider the need to quickly and easily attach or detach the handweights to or from the rope during an aerobic exercise routine. The inordinate number of steps required to attach or detach the handweights frustrates the user and interrupts the flow of the routine. This interruption causes delay between each exercise and diminishes the overall value of the routine. It would, therefore, be desirable to have a weighted handle for a jump rope that is less bulky and may be quickly and easily attached to or detached from a jump rope.

SUMMARY OF THE INVENTION

The present invention comprises a weighted handle for a jump rope. In practice, the invention incorporates two weighted handles one secured to each end of a jump rope. Each weighted handle includes an attachment connected to the jump rope and a handweight removably secured to the attachment.

The attachment has an internally threaded open end and a closed end. The closed end defines a central aperture for receiving the end of the jump rope. The attachment also contains a ball bearing connector housed in the closed end. The ball bearing connector is attached to the end of the jump rope which is passed through the aperture. Thus, the jump rope is secured to the attachment yet it may freely rotate within the attachment.

The handweight has an externally threaded end which may be engaged to the internally threaded open end of the attachment. Each handweight may be attached to or detached from the attachment simply by screwing it to or unscrewing it from the attachment.

DETAILED DESCRIPTION OF THE PREFERRED EMBODIMENT

Figure 1:
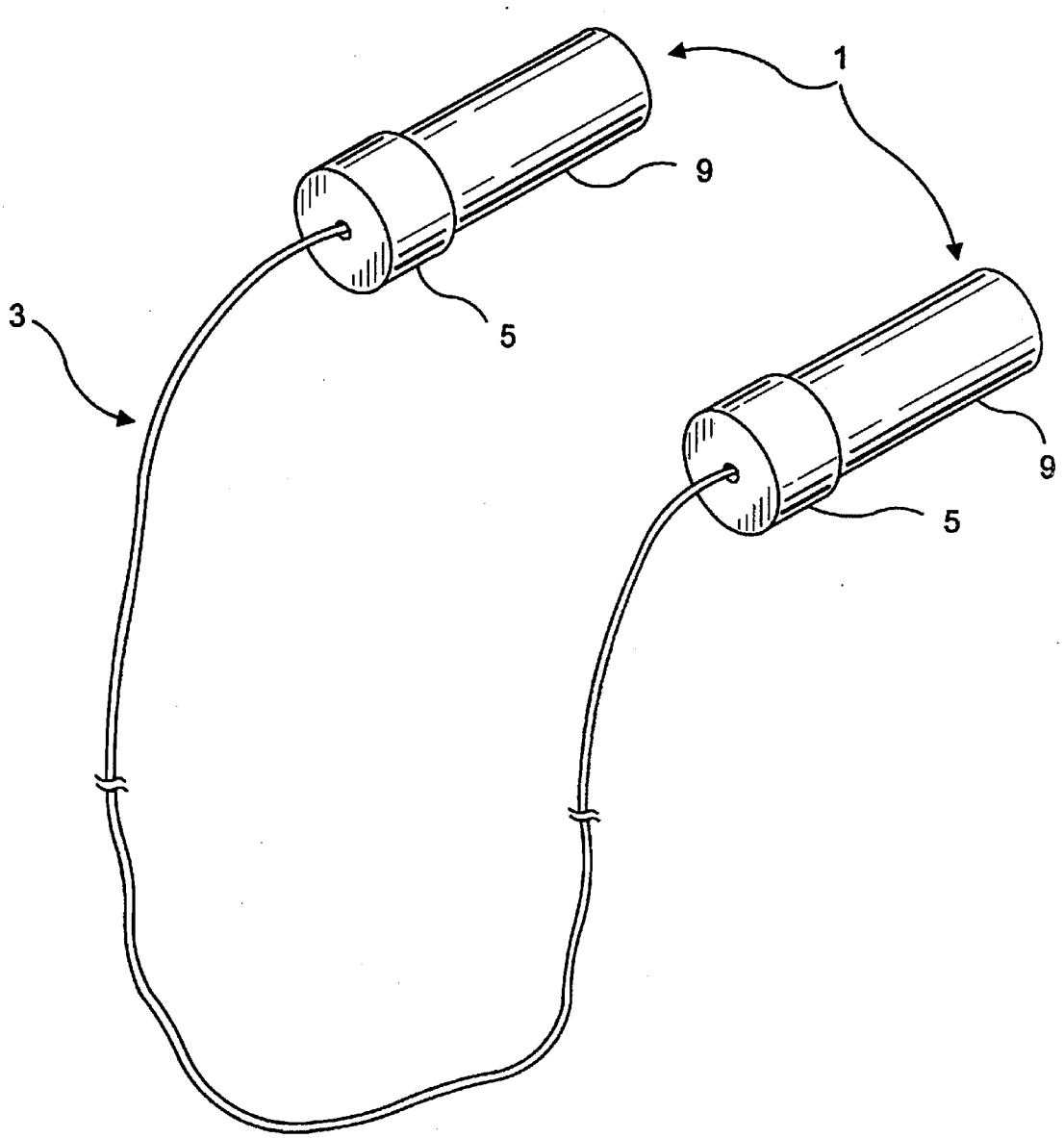
FIG. 1 is a perspective view of the weighted handle jump rope.

Referring to FIG. 1, the invention comprises a pair of weighted handles 1, secured to each end of a jump rope 3. Each weighted handle 1, includes an attachment 5, connected to the jump rope 3, and a handweight 9, removably secured to the attachment 5.

Figure 2:
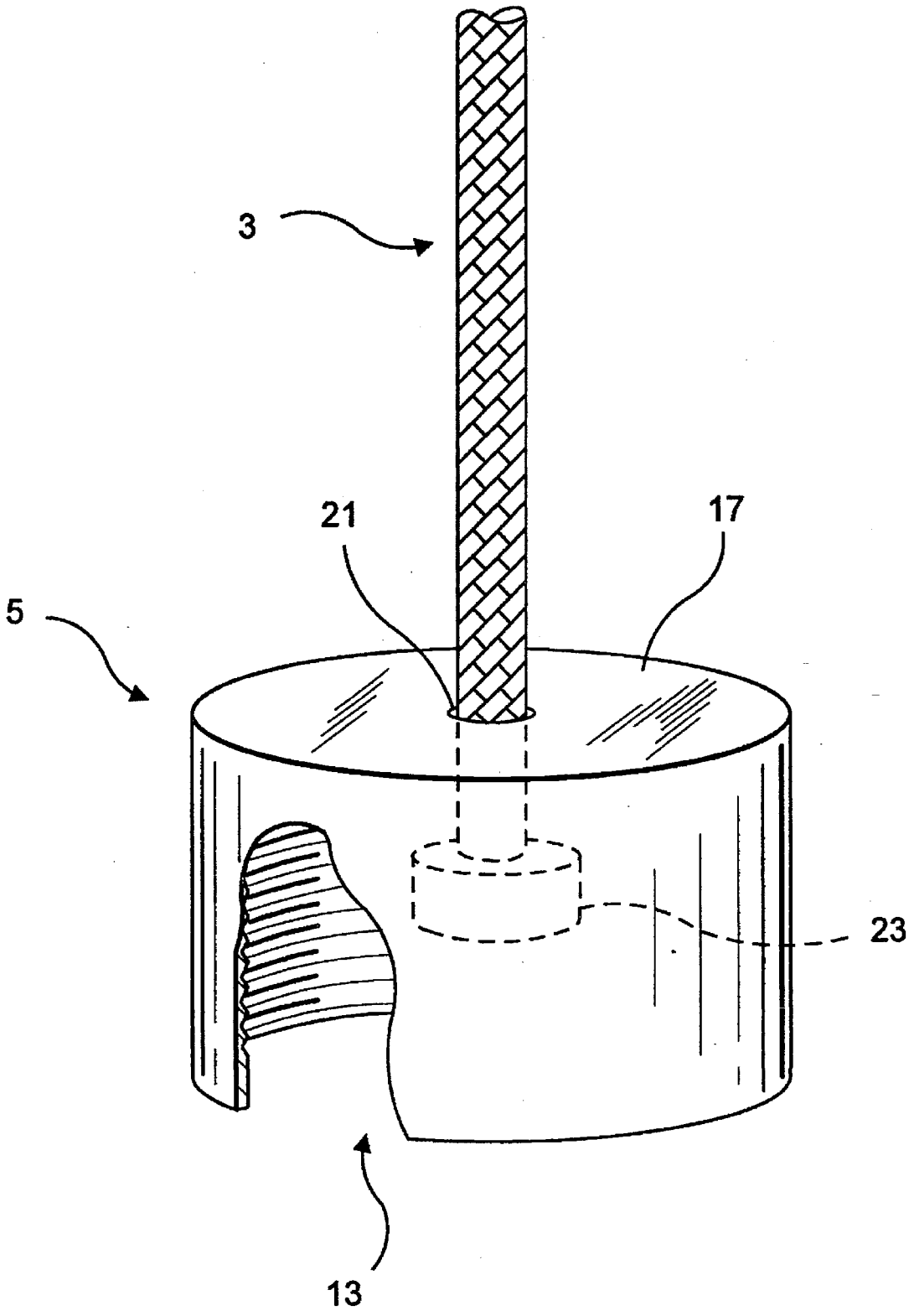
FIG. 2 is a perspective view of the attachment detached from the weighted handle.

As shown in FIG. 2, the attachment 5, has an internally threaded open end 13, and a closed end 17. The closed end defines a central aperture 21, for receiving and securing the end of the jump rope 3. The attachment 5, also contains a ball bearing connector 23, housed in the closed end 17. The ball bearing connector 23, is attached to the jump rope 3, which is passed through the aperture 21. Thus, the jump rope 3, is secured to the attachment 5, yet the jump rope 3, may rotate about its axis within the attachment 5.

Figure 3:
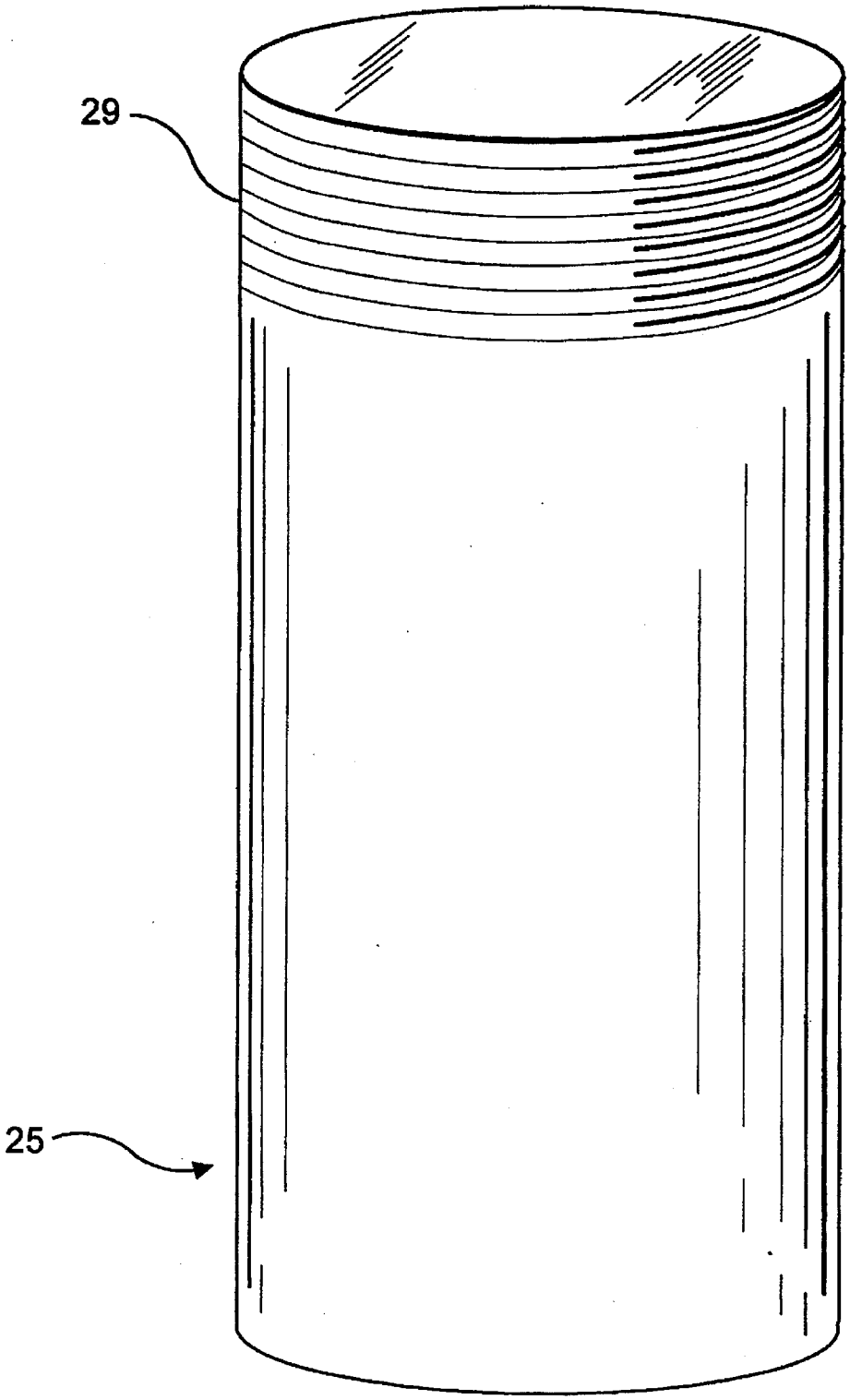
FIG. 3 is a perspective view of the weighted handle detached from the attachment.

Referring to FIG. 3, the handweight 25, has an externally threaded end 29. Threaded end 29, may be engaged to the internally threaded open end, 13, of the attachment 5 (See FIG. 2). Thus, the handweight 25, may be attached to or detached from the attachment 5, simply by screwing it to or unscrewing it from the attachment 5. The handweight 25, may vary in weight. Typical handweights used in the invention fall within the range of 1 to 3 pounds.

Figure 4:
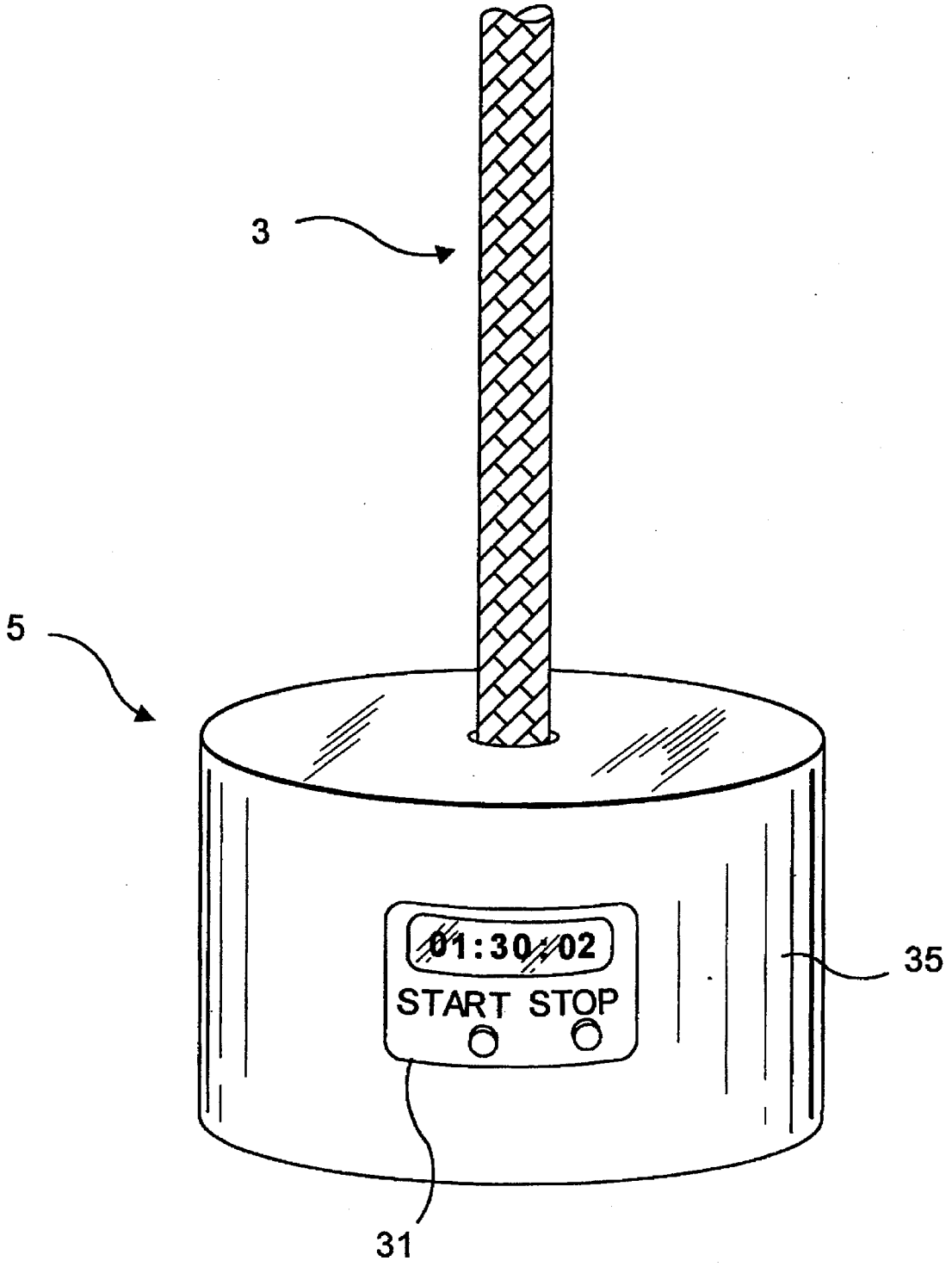
FIG. 4 is a perspective view of an attachment containing a stopwatch.

FIG. 4 shows that the attachment 5, may optionally contain an LCD stopwatch 31 having start and stop buttons located on an exterior face 35 of the attachment 5. This feature facilitates timing of each exercise set in the cross-training routine.

The invention enables a person to use the jump rope in one exercise of an aerobic routine and then quickly and easily unscrew the handweights from the jump rope for use in a subsequent strength exercise. The stopwatch can be used to keep track of the time of each exercise in the routine. Finally, a separate jump rope and handweights are no longer necessary. This reduces the total number of separate pieces that a person must carry to the gym.

I claim:

1. A weighted handle jump rope kit consisting essentially of:

a jump rope having two ends;

two cylindrical cup attachments connected to each end of the jump rope, each attachment having an internally threaded open end and a closed end defining a central aperture for receiving the end of the jump rope;

a ball bearing connector housed in the closed end of each attachment and attached to the end of the jump rope to rotatably secure the rope in the closed end; and a pair of solid cylindrical weighted handles configured for being grasped, each handle having an externally threaded end for being screwed into the internally threaded open end of each attachment;

whereby the handles may be screwed to the attachments to create a weighted-handle jump rope, and unscrewed from the attachments for use as a free-weights.

2. A weighted handle jump rope kit according to claim 1, further comprising multiple pairs of handles, each pair having a different handle weight of 1 to 3 pounds.

3. A weighted handle jump rope kit according to claim 2, further comprising a stopwatch housed on an exterior face of either cylindrical cup attachment.

* * * * *